US005429098A

United States Patent [19]

Tomisawa

[11] Patent Number: 5,429,098

[45] Date of Patent: Jul. 4, 1995

[54] METHOD AND APPARATUS FOR CONTROLLING THE TREATMENT OF FUEL VAPOR OF AN INTERNAL COMBUSTION ENGINE

[75] Inventor: Naoki Tomisawa, Atsugi, Japan

[73] Assignee: Unisia Jecs Corporation, Atsugi, Japan

[21] Appl. No.: 193,753

[22] Filed: Feb. 3, 1994

[30] Foreign Application Priority Data

Feb. 5, 1993 [JP] Japan ..... 5-019030

[51] Int. Cl.[6] ..... F02M 33/02

[52] U.S. Cl. ..... 123/520

[58] Field of Search ..... 123/518, 519, 520

[56] References Cited

U.S. PATENT DOCUMENTS

| | | | |
|---|---|---|---|
| 4,658,797 | 4/1987 | Brand | 123/520 |
| 5,054,454 | 10/1991 | Hamburg | 123/520 |
| 5,099,439 | 3/1992 | Saito | 123/520 |
| 5,113,834 | 5/1992 | Aramaki | 123/520 |
| 5,139,001 | 8/1992 | Tada | 123/520 |
| 5,143,040 | 9/1992 | Okawa et al. | 123/520 |
| 5,150,689 | 9/1992 | Yano et al. | 123/520 |
| 5,216,995 | 6/1993 | Hosoda et al. | 123/520 |
| 5,216,997 | 6/1993 | Osanai et al. | 123/520 |
| 5,245,975 | 9/1993 | Ito | 123/520 |
| 5,263,460 | 11/1993 | Baxter | 123/520 |
| 5,269,279 | 12/1993 | Mukai et al. | 123/520 |
| 5,273,018 | 12/1993 | Suzuki | 123/520 |
| 5,323,751 | 6/1994 | Osanai et al. | 123/520 |
| 5,351,193 | 9/1994 | Poirier et al. | 123/520 |

FOREIGN PATENT DOCUMENTS 6-93932 4/1994 Japan .

*Primary Examiner*—Henry C. Yuen
*Assistant Examiner*—Thomas N. Moulis
*Attorney, Agent, or Firm*—Foley & Lardner

[57] ABSTRACT

The open and close frequency of an intake control valve 30 for controlling an intake amount at an open and close time proportion, is variably controlled in accordance with engine rotational speed or elapsed time. As a result, during control of fuel vapor treatment, biased supply to a specific cylinder of fuel vapor drawn into the engine from an absorption device 29 is suppressed, so that an averaged air-fuel ratio can be obtained for each cylinder. Therefore, combustion variation between the cylinders can be avoided, the increased engine vibration due to the resultant increase in combustion pressure variation reduced, and the deterioration in exhaust composition and vehicle driving performance can be minimized.

18 Claims, 8 Drawing Sheets

METHOD AND APPARATUS FOR CONTROLLING THE TREATMENT OF FUEL VAPOR OF AN INTERNAL COMBUSTION ENGINE

FIELD OF THE INVENTION

The present invention relates to a method and apparatus for controlling the treatment of fuel vapor of vehicular, marine or stationary internal combustion engines. In particular, the invention relates to technology to improve fuel vapor treatment control methods and apparatus used to treat fuel vapor generated inside a fuel tank.

DESCRIPTION OF THE RELATED ART

Conventional methods and apparatus considered for controlling the treatment of fuel vapor in order to prevent fuel vapor generated inside the tank from diffusing into the atmosphere when refilling the tank and becoming a source of air pollution, involve firstly absorbing the fuel vapor into an absorption device referred to as a canister, and then desorbing and supplying the absorbed fuel to the intake system of the engine under negative intake pressure, at predetermined engine operating conditions. Recently however, such stringent conditions are required to reliably reduce the discharge of pollutants from the engine into the atmosphere, that the discharge amount of exhaust pollutants from engine combustion should be kept within a regulation value, even for the case when fuel vapor treatment is started with the canister filled with fuel vapor (a condition resulting in an extremely rich air-fuel ratio for the mixture desorbed and supplied from the absorption device).

When treating the fuel vapor, to ensure that a large amount of fuel vapor is not desorbed and supplied at once (i.e. to ensure the air-fuel ratio is not over rich), an intake control valve may be provided in the passage between the absorption device and the engine intake system. The intake amount of fuel vapor can thus be controlled by periodically opening and closing the valve and by controlling the valve open time proportion (opening duty). In this case, due to the difficulty in accurately controlling flow rate through control of the opening area, accuracy is ensured and control simplified by duty control which controls a flow rate by repeatedly operating the valve to fully open and close the valve and then varying the valve open time proportion.

When treating the fuel vapor , since a surplus fuel vapor is drawn into the engine, a large discrepancy occurs in the air-fuel ratio under normal air-fuel ratio control, resulting in an increase in the discharge amount of exhausted pollutants. Therefore it is necessary to control the engine fuel vapor intake amount, and the amount of fuel supplied by the fuel supply device to the engine, in order to maintain the air-fuel ratio at an appropriate level. In this respect, the present inventor has proposed in Japanese patent application No. 4-239852, an internal combustion engine fuel vapor treatment apparatus which estimates the amount of fuel vapor absorbed in the canister, and controls the opening of the intake control valve to thereby control the engine fuel vapor intake amount to a predetermined level.

With such a device an appropriate air-fuel ratio can be maintained for the engine overall. That is to say the total amount of fuel supplied to the engine can be controlled to give a predetermined air-fuel ratio. However, the air-fuel ratio of the mixture supplied to the individual cylinders cannot be averaged nor controlled to a predetermined value.

This is because, at the time of desorbing and supplying the fuel vapor absorbed in the canister to the engine, the intake control valve is opened and closed periodically so that the fuel vapor is supplied intermittently to the intake system in accordance with the opening and closing. As a result, rich and lean portions of the air-fuel ratio are alternately produced in the mixture supplied to the engine. Therefore, since the intake control valve is opened and closed at a constant opening and closing frequency (frequency from valve open to valve close and back to valve open), then with a change in the intake valve open and close cycle or the intake pulsation frequency with engine rotational speed, a different resultant fuel vapor amount is supplied to each cylinder of the engine. This produces a difference in the air-fuel ratio between the cylinders. That is to say, the intake proportion of the rich portion of the mixture differs for each cylinder. This difference in air-fuel ratio between the cylinders causes variation in combustion between the cylinders, resulting in increased engine vibration due to the resultant increase in combustion pressure variation. It also causes various undesirable conditions such as deterioration in exhaust composition. Such problems are similarly apparent in apparatus for control of fuel vapor treatment which do not specifically control the intake amount.

With the above device, it has been considered to keep the open and close frequency of the intake control valve at a frequency greater than the normal maximum rotational speed of the engine, so that the alternating rich and lean portions in mixture strength can be practically ignored. However, from the point of view of endurance of the intake control valve itself, this is not practical.

An alternative method is to provide a surge tank in the intake passage to smooth out the rich and lean portions in mixture strength. However with this method, since there is a response delay until the mixture stored in the surge tank is supplied to the engine, a step is produced in the air-fuel ratio. This results in a deterioration in vehicle driving performance and an increase in exhaust pollutants.

SUMMARY OF THE INVENTION

In view of the above situation, an object of the present invention is to suppress the differences in air-fuel ratio for each cylinder caused by rich and lean portions in mixture strength (air-fuel ratio) produced with the opening and closing of the intake control valve when fuel vapor absorbed in the absorption device is desorbed and supplied to the engine, to thereby obtain a desirable air-fuel ratio which is averaged between the cylinders. The ultimate object being to reduce combustion variation between cylinders, lower the discharge amount of exhaust pollutants, and minimize deterioration in the vehicle driving performance.

A further object in addition to the above, is to achieve good air-fuel ratio control of the engine during control of the fuel vapor treatment.

Moreover, as well as the above objectives, it is a further object to control the air-fuel ratio to a high accuracy in spite of changes in the amount of fuel vapor absorbed in the absorption device and changes in the amount of fuel vapor supplied.

In order to achieve the above objectives, the method and apparatus according to the present invention for controlling the treatment of a fuel vapor of an internal combustion engine involves: temporarily absorbing and storing fuel vapor from a fuel tank in an absorption device; then introducing under predetermined engine operating conditions, a negative intake pressure of the engine to the absorption device through a periodically opened and closed intake control valve disposed between the absorption device and the intake system of the engine, to thereby desorb the absorbed fuel vapor; and finally supplying this to the engine intake system while variably controlling the open and close frequency of the intake control valve.

With such a construction, the open and close frequency of the intake control valve can be changed with the change in the intake valve open and close cycle or intake pulsation frequency with engine rotational speed. As a result, the biased supply to one specific cylinder of a mixture having a large or small air-fuel ratio can be prevented. Therefore, since the air-fuel ratio of the mixture supplied to each cylinder can be approximately averaged between the cylinders, a desirable air-fuel ratio differing only slightly between the cylinders can be obtained. Hence combustion variation between the cylinders can be avoided, the increased engine vibration due to the resultant increase in combustion pressure variation reduced, and the deterioration in exhaust composition and vehicle driving performance minimized.

A suitable open and close frequency control device may involve control to increase the open and close frequency of the intake control valve with an increase in engine rotational speed, or may involve variable control to increase and decrease the open and close frequency of the intake control valve with an elapsed time. In the latter case the open and close frequency can be kept relatively low. This may be advantageous from the point of view of endurance of the intake control valve, compared to the former case involving an increase in the open and close frequency with increase in engine rotational speed.

To effectively carry out air-fuel ratio control of the mixture supplied to the engine, while controlling treatment of the fuel vapor, then in addition to the above construction, an open and close time proportion of the intake control valve can be set on the basis of the engine operating conditions, to thereby control the intake level of the fuel vapor amount. As a result the fuel vapor amount controlled to a predetermined level can be desorbed from the absorption device, enabling good air-fuel ratio control to be achieved.

In order to carry out control of the air-fuel ratio to a higher accuracy, then in addition to the beforementioned construction, the amount of fuel vapor absorbed in the absorption device can first be estimated. Then the open and close time proportion of the intake control valve set on the basis of the engine operating conditions is corrected in accordance with the estimated fuel vapor amount. Consequently, even with a change in the amount of fuel vapor absorbed in the absorption device, this change can be followed, enabling highly accurate air-fuel ratio control to be achieved.

Other objects and aspects of the present invention will become apparent from the following description of the preferred embodiments taken in conjunction with the appended drawings.

DETAILED DESCRIPTION OF THE PREFERRED EMBODIMENTS

Embodiments of the methods and apparatus for controlling the treatment of fuel vapor of an internal combustion engine according to the present invention are illustrated in FIG. 2 through FIG. 5.

Figure 1:
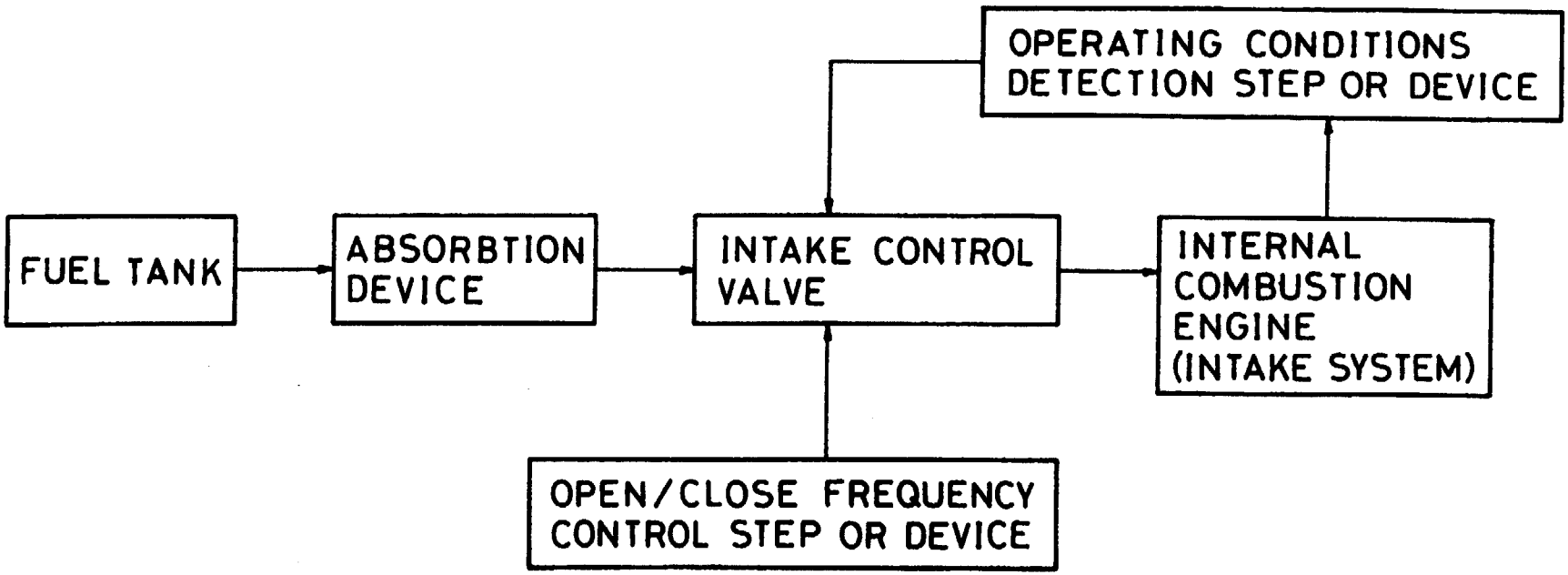
FIG. 1 is a block diagram illustrating a structure of the present invention.
Figure 2:
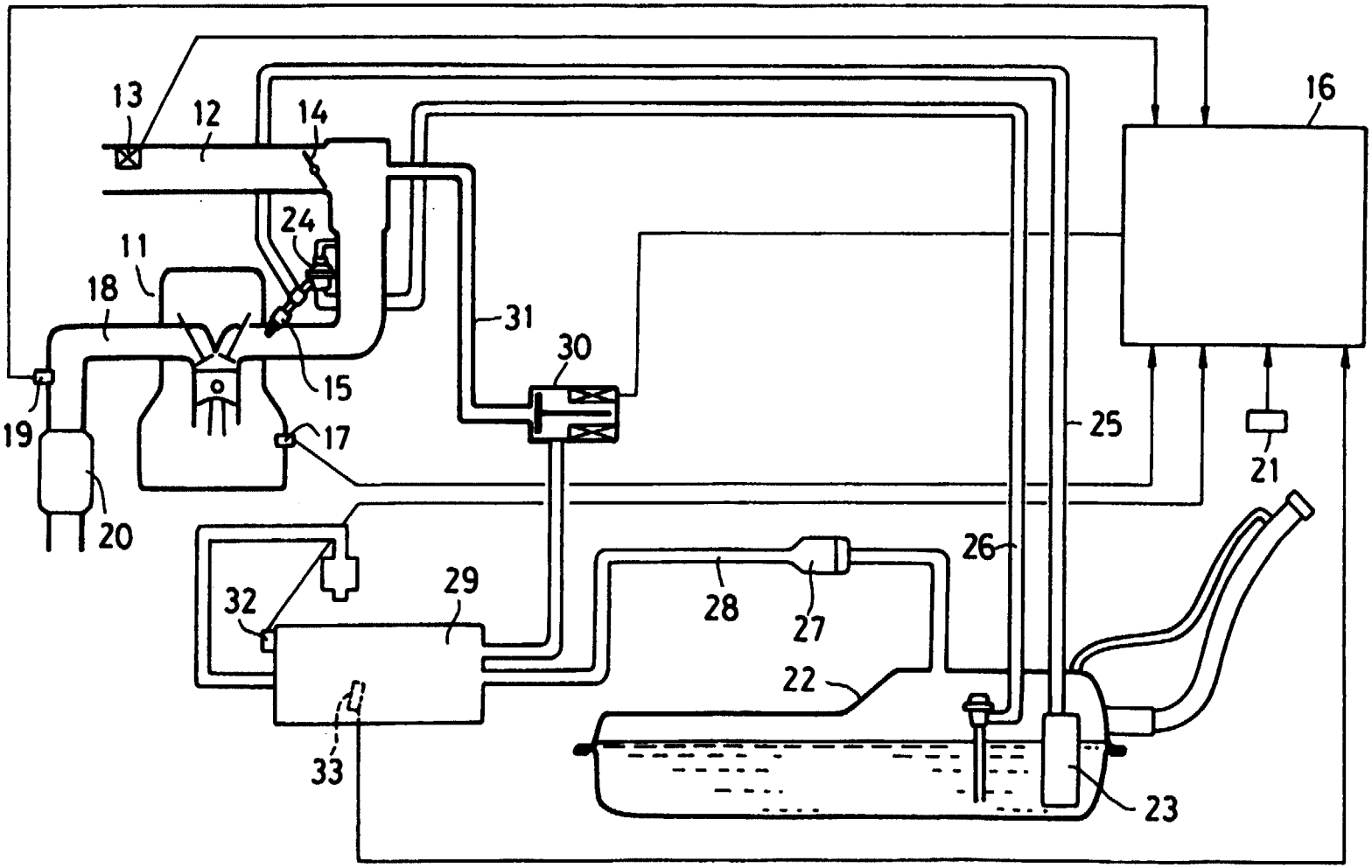
FIG. 2 is a schematic diagram illustrating an overall construction of a first and second embodiment of the present invention.

In FIG. 2 which shows the construction of a first embodiment, an intake flow path 12 of an engine 11 is provided with an air flow meter 13 for detecting an intake flow rate Q, and a throttle valve 14 connected to an accelerator pedal, for controlling the intake flow rate Q. Solenoid type fuel injection valves 15 (only one shown in FIG. 2) for supplying fuel to each cylinder are provided in a downstream manifold.

The fuel injection valves 15 are driven open by an injection pulse signal from a control unit 16 incorporating a micro-computer, to thereby inject fuel. A water temperature sensor 17 for detecting the cooling water temperature Tw of the cooling jacket of the engine 11 is also provided. An air-fuel ratio sensor 19 is provided in the exhaust passage 18 for detecting the air-fuel ratio of the intake mixture by detecting the oxygen concentration in the exhaust gas at the manifold junction, while a ternary catalyst 20 is provided in the downstream exhaust pipe as an exhaust purification catalyst for oxidizing CO, and HC and reducing NOx to thereby purify the exhaust gases.

A crank angle sensor 21 is provided inside a distributor (not shown in FIG. 2). The engine rotational speed N is detected either by counting in a fixed period the number of crank unit angle signals synchronized with the engine rotation and output from the crank angle sensor 21, or by measuring the period of a crank angle reference signal.

Here the crank angle sensor 21, air-fuel ratio sensor 19, water temperature sensor 17, and air flow meter 13 constitute an operating conditions detection device.

Next is a description of the fuel supply system. A fuel pump 23 is provided inside a fuel tank 22. Fuel pumped under pressure by the fuel pump 23 passes through a fuel supply line 25 fitted with a pressure regulator 24 whereby fuel is controlled to a predetermined pressure, and is then supplied to the fuel injection valves 15. Surplus fuel from the pressure regulator 24 is returned to the fuel tank 22 by way of a fuel return path 26.

Fuel vapor accumulating in the upper space of the fuel tank 22 is led out to a canister 29 by way of a fuel vapor line 28 fitted with a check valve 27. Then under predetermined operating conditions, the fuel vapor which is temporarily absorbed in the canister 29 is desorbed and supplied to the intake flow path 12 downstream of the throttle valve 14, by way of a fuel vapor supply path 31 fitted with an intake control valve 30.

A first temperature sensor 32 for detecting the temperature surrounding the canister 29, and a second temperature sensor 33 for detecting the temperature inside the canister 29 are also provided. The first temperature sensor 32 and second temperature sensor 33 constitute a device for detecting temperature conditions of the canister 29.

The control unit 16 estimates the amount of fuel vapor absorbed in the canister 29, on the basis of conditions which include the temperature conditions of the canister 29 detected by the first temperature sensor 32 and the second temperature sensor 33. It then controls the opening and closing of the intake control valve 30 based on the estimated fuel vapor amount, to thereby control the fuel vapor intake amount. The control unit 16 is also able to set the open and close frequency "f" of the intake control valve 30, based on the engine rotational speed N.

In this way the intake control valve 30 is controlled by set control signals from the control unit 16, which set the open and close time, and the open and close frequency of the intake control valve 30.

Figure 3A:
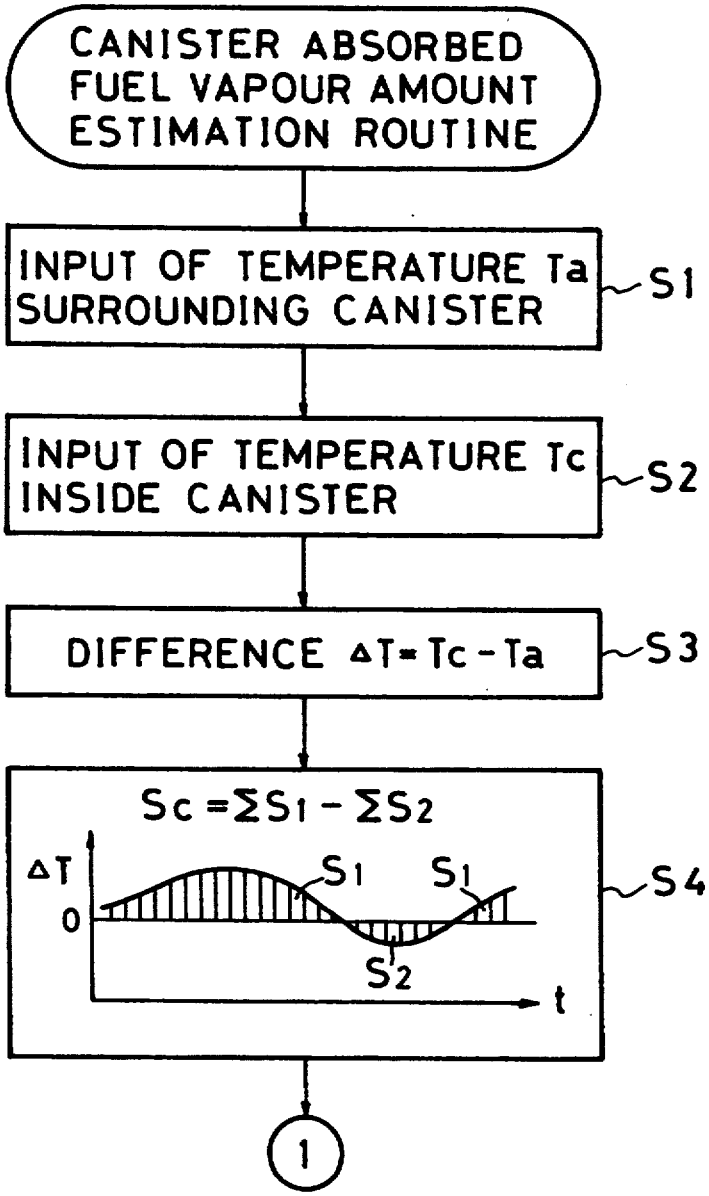
FIGS. 3A and 3B are flow charts showing a routine for estimating an amount of fuel vapor absorbed in a canister according to the first and second embodiments.
Figure 3B:
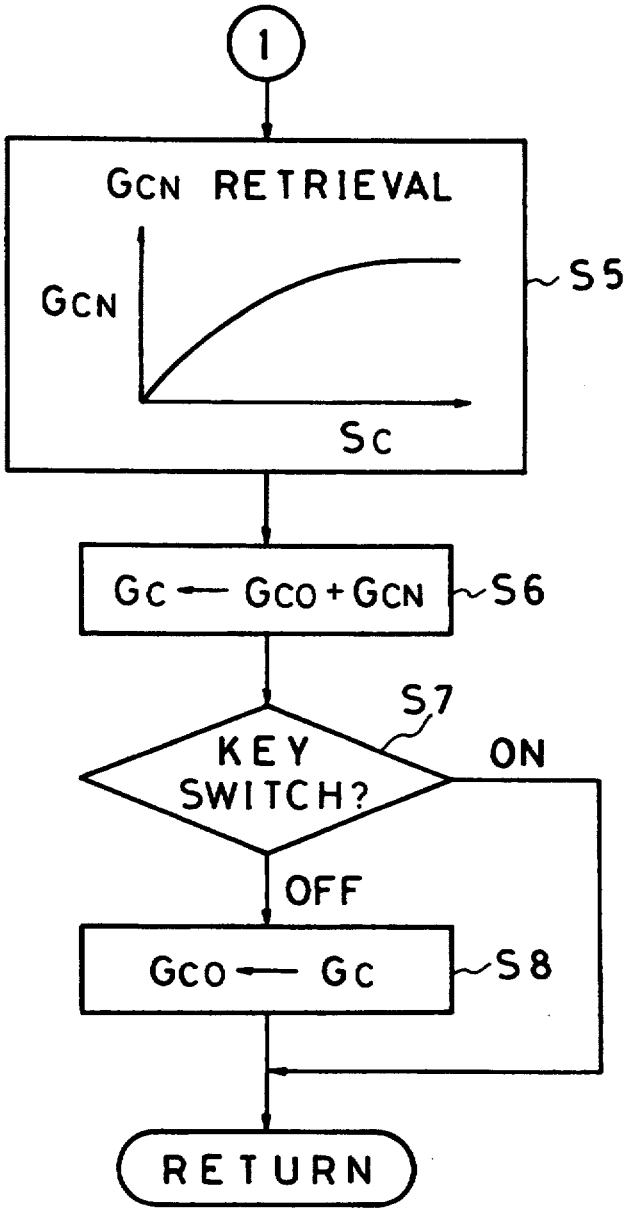
Figure 4A:
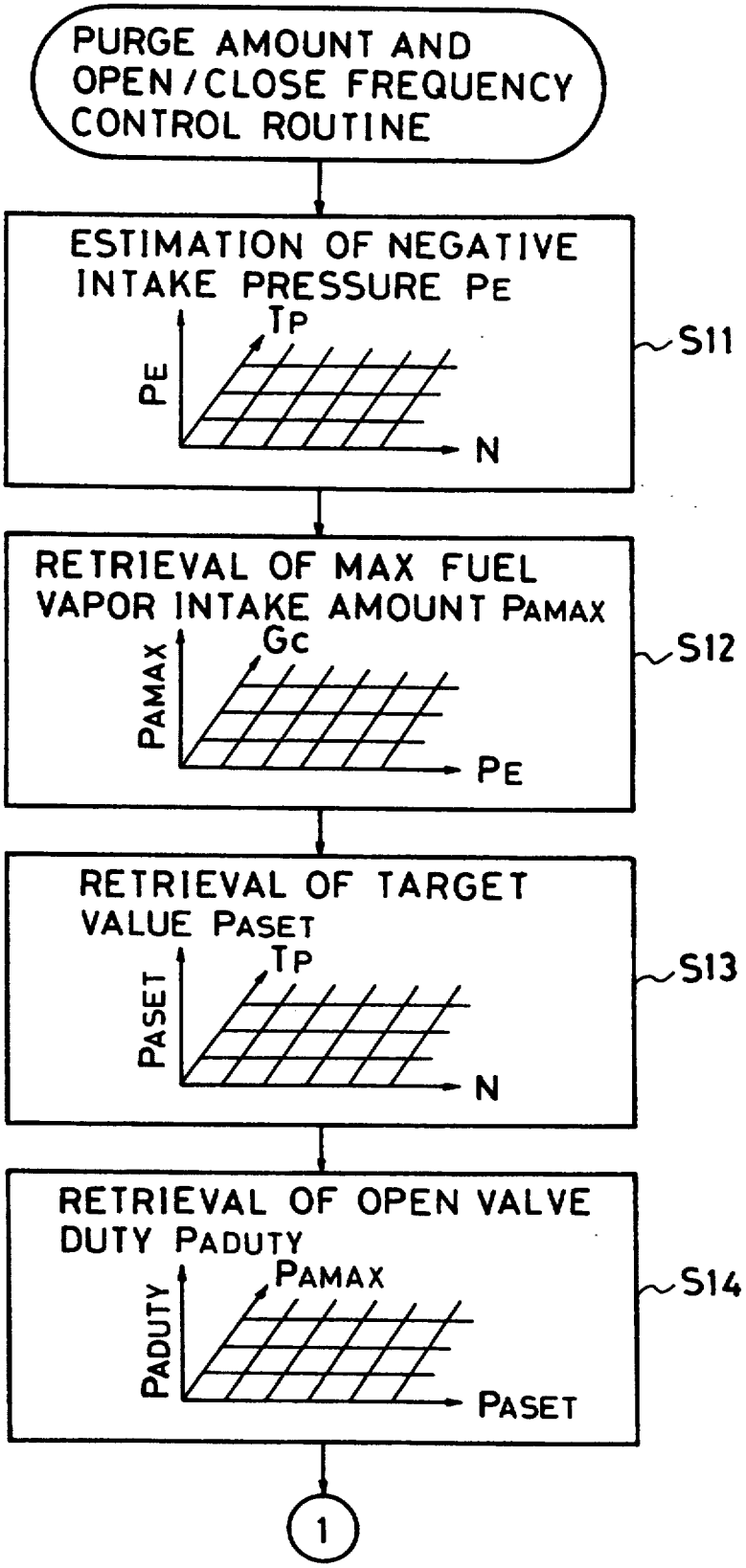
FIGS. 4A and 4B are flow charts showing a routine for control of the fuel vapor intake amount and open and close frequency of the intake control valve according to the first embodiment.
Figure 4B:
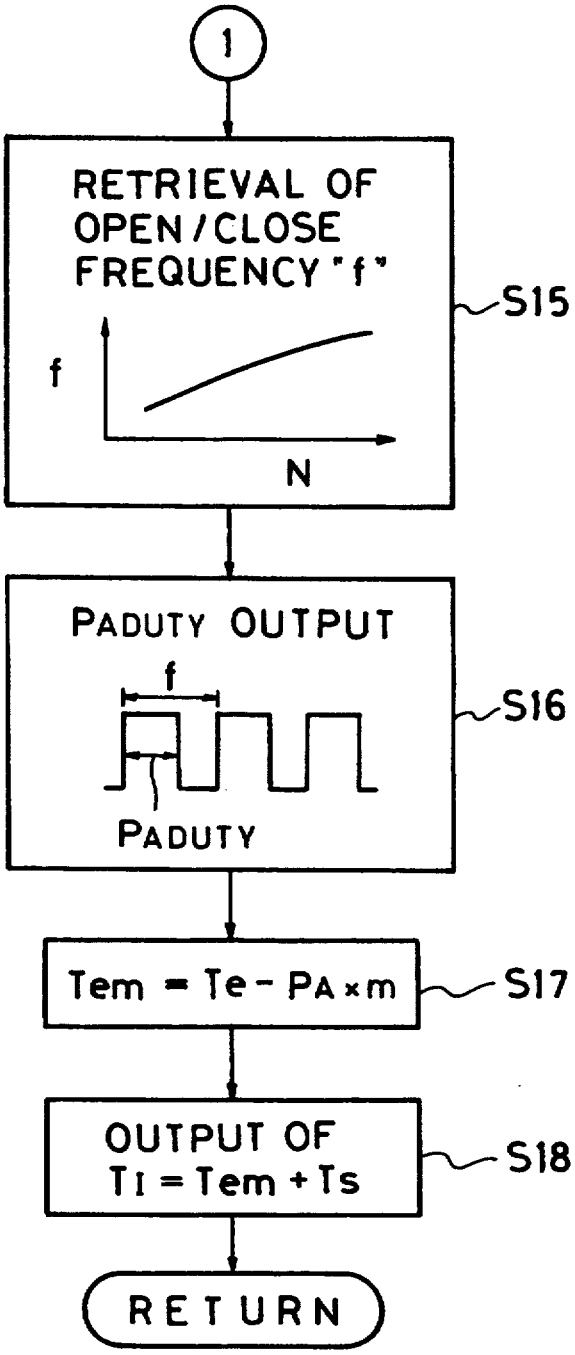

Next is a description in accordance with the flow charts of FIG. 3 and FIG. 4 of the estimation of the amount of fuel vapor absorbed in the canister 29, and the control of the air-fuel ratio based on the estimated amount, both being carried out by the control unit 16.

With the routine shown in FIG. 3 for estimating the amount of fuel vapor absorbed in the canister 29, in step 1 (denoted by S1 in the figure with subsequent steps indicated in a similar manner), the temperature Ta surrounding the canister 29 detected by the first temperature sensor 32 is read in.

In step 2, the temperature Tc inside the canister 29 detected by the second temperature sensor 33 is read in.

In step 3, the difference AT between the temperature Ta surrounding the canister 29 and the temperature Tc inside the canister 29 ($=Tc-Ta$) is obtained.

In step 4, the time integral value Sc for the obtained difference $\Delta T$ is computed. Here $Sc=\int \Delta T=\Sigma S_1-\Sigma S_2$ where:

$\Sigma S_1$ is the integral value of $\Delta T$ having the positive value for the exothermic reaction due to absorption of the fuel vapor, and $\Sigma S_2$ is the integral value of $\Delta T$ having the negative value for the endothermic reaction due to desorption of the fuel vapor.

In step 5, the fuel vapor amount GcN absorbed in the canister 29 during the recent operation, is estimated by retrieval from a map previously obtained experimentally and stored in the ROM, on the basis of-the computed time integral value Sc of the difference $\Delta T$. When $\Sigma S_1<\Sigma S_2$, then the desorption amount is larger than the absorption amount and GcN has a negative value.

In step 6, the fuel vapor amount Gc presently absorbed in the canister 29 is estimated by adding the fuel vapor amount GcN absorbed at the recent operation time to the fuel vapor amount Gco absorbed in the canister 29 during operation up until the previous time.

In step 7, it is judged if the key switch is on or off. If the key switch is off, the estimated fuel vapor amount Gc is stored in a back up memory as Gco.

The above routine carried out by the control unit 16 corresponds to the fuel vapor amount estimation device of the present invention. The fuel vapor amount estimation device however is not limited to this. For example, the fuel vapor amount absorbed in the canister 29 may be estimated by detecting the weight of the canister 29, or by detecting the air-fuel ratio inside the fuel vapor supply path 31.

Next is a description in accordance with the flow chart of FIG. 4, of the intake control valve 30 open and close control, for controlling the intake amount of fuel vapor and the open and close frequency of the intake control valve 30, based on the estimated fuel vapor amount Gc absorbed in the canister 29. This control is carried out when the previously set predetermined operating conditions are detected.

In step 11, a negative intake pressure PE on the downstream side of the throttle valve 14 of the intake flow path 12 is estimated on the basis of the engine rotational speed N and basic fuel injection amount TP.

In step 12, a maximum fuel vapor intake amount PAMAX that can be desorbed (i.e. for the case when the intake control valve 30 is fully opened), is obtained by retrieval from a pre-set map, on the basis of the estimated negative intake pressure PIg and absorbed fuel vapor amount Gc.

In step 13, the target value PASET for the intake amount of fuel vapor is obtained by retrieval from a pre-set map, on the basis of the engine rotational speed N and the basic fuel injection amount TP, (or the negative intake pressure PIg estimated in step 11).

In step 14, the resultant open valve duty PADUTY for the intake control valve 30, to give the target value PASET, is obtained by retrieval from a preset map on the basis of the maximum fuel vapor intake amount PAMAX and the target value PASET.

Steps 11 through 14 constitute the intake amount control device and the intake amount correction device of the present invention.

Next in step 15, the open and close frequency "f" of the control signal for the open valve duty PADUTY obtained in step 14, is obtained by retrieval from a preset map on the basis of the engine rotational speed N. In this case, the open and close frequency "f" of the intake control valve 30 shows an approximately proportional relationship, increasing with an increase in the engine rotational speed N. However it is not limited to this relationship, the essential requirement being that the rich portion of the mixture air-fuel ratio supplied to each cylinder is supplied approximately evenly to each cylinder by synchronizing the open and close frequency "f" with the change in intake valve open and close cycle or the change in the intake pulsation frequency, with engine rotational speed N.

In step 16, the open valve duty PADUTY is output to the intake control valve 30 with the frequency "f" obtained in step 15. Steps 15 and 16 constitute an open and close frequency control device of the intake control valve.

In step 17, the effective fuel injection pulse width Tem for the fuel injection valve 15 is obtained by subtracting the target value PASET for the fuel vapor intake amount converted to an injection pulse width by multiplying by a conversion constant "m", from an effective injection pulse width Te of the fuel injection valve 15 set for the engine operating conditions (engine rotational speed N, intake flow rate Q, water temperature Tw etc.) for the case when the fuel vapor is not desorbed and absorbed.

In step 18, a correction injection pulse width Ts due to battery voltage correction is added to the effective injection pulse width Tem, to give an injection pulse width T1. An injection pulse signal of pulse width T1 is then output to the fuel injection valve 15.

In the first embodiment, by maintaining the fuel vapor intake amount at the target value set by the engine operating conditions, and by supplying an amount of fuel less than the target value portion from the fuel injection valve 15 to the engine 11, the overall air-fuel ratio for the engine 11 can be controlled to remain constant. Also, since the open and close frequency "f" of the intake control valve 30 is set to correspond to the engine rotational speed N, it can be synchronized with the change in the intake valve open and close cycle or the change in the intake pulsation frequency, with engine rotational speed N. As a result, the air-fuel ratio of the mixture drawn into each cylinder can be approximately even for all cylinders. Hence differences in air-fuel ratio for each cylinder can be suppressed, so that a desired air-fuel ratio averaged between cylinders can be obtained. Consequently, combustion fluctuations between cylinders can be suppressed, the discharge amount of exhaust pollutants reduced, and deterioration in vehicle driving performance minimized.

Next is a description of a second embodiment based on the figures.

In the second embodiment the setting of the open and close frequency "f" for the intake control valve 30 is different to that for the first embodiment.

Figure 5A:
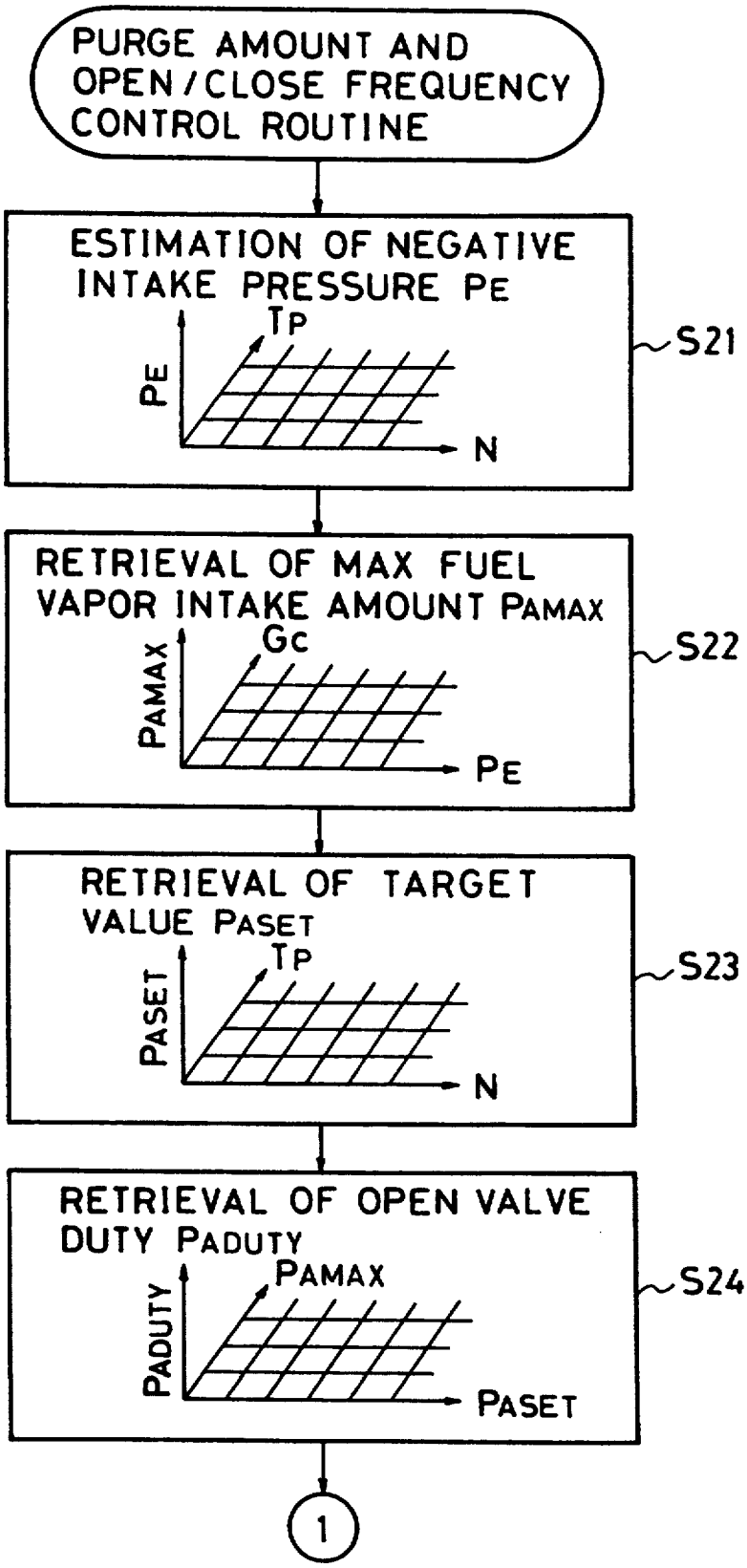
FIGS. 5A and 5B are flow charts showing a routine for control of the fuel vapor intake amount and open and close frequency of the intake control valve according to the second embodiment.
Figure 5B:
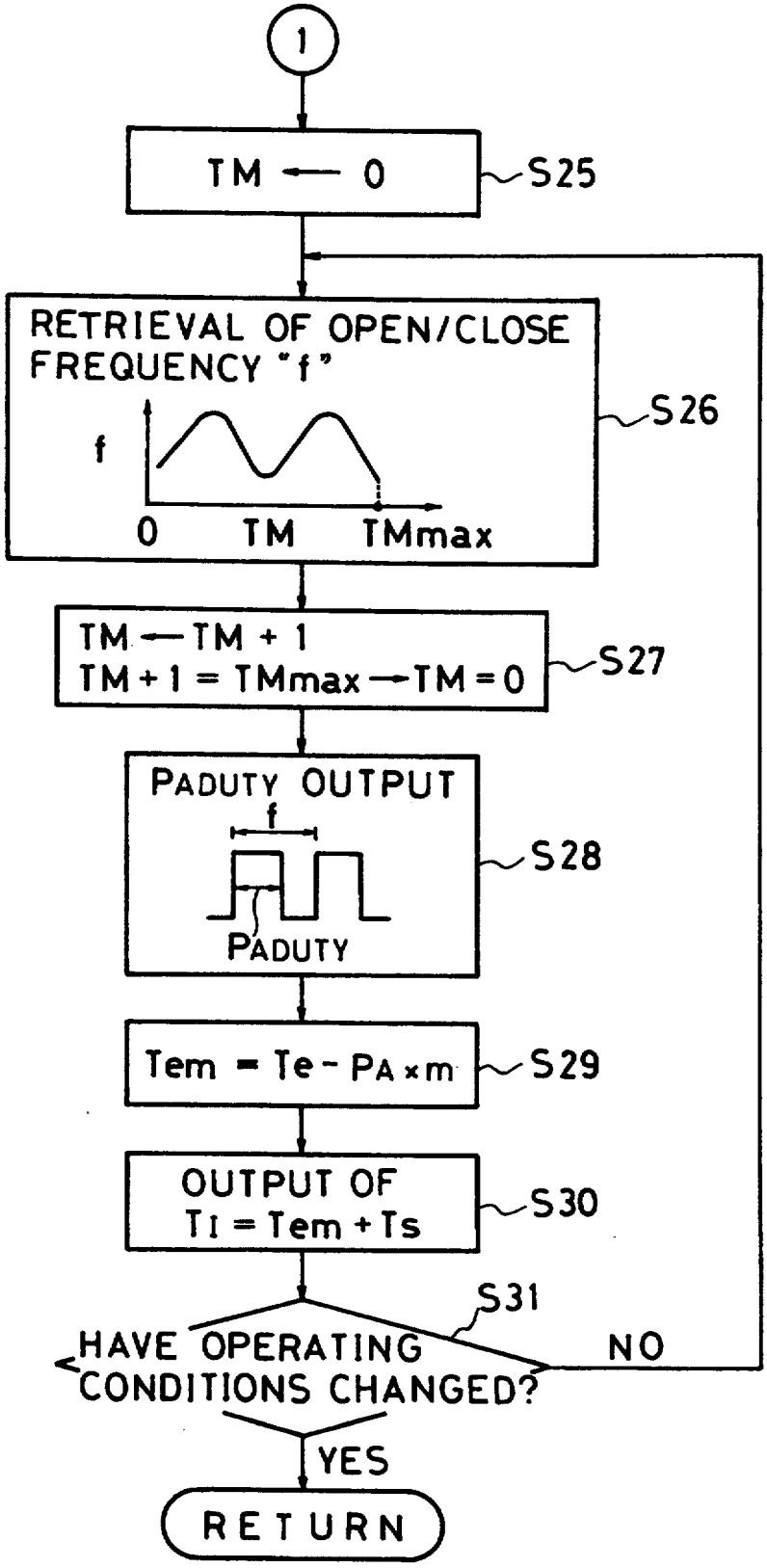

The flow chart shown in FIG. 5 is the same as the flow chart of FIG. 4 for the first embodiment as far as steps 21 through 24 are concerned, and description of these parts is omitted for brevity.

In step 25, a count value TM for a timer inside the control unit 16 is set to zero.

In step 26, the open and close frequency "f" of the control signal for the open valve duty PADUTY obtained in step 24, is obtained by retrieval from a pre-set map in the control unit 16, on the basis of the count value (time) TM. The map is set so as to variably increase or decrease the open and close frequency "f" of the intake control valve 30 with respect to the time TM. Hence a biased supply to one cylinder of a mixture with a rich or lean air-fuel ratio can be suppressed. As a result, compared to the case of the conventional example, wherein the open and close period of the intake control valve 30 is fixed, the air-fuel ratio of the mixture supplied to each cylinder can be made approximately even.

In step 27, the timer inside the control unit 16 counts up. When the counted up time reaches a value TMmax, then TM is set to zero.

In step 28, the open valve duty PADUTY is output to the intake control valve 30 with the frequency "f" obtained in step 26. Steps 25, 26, 27 and 28 constitute the open and close frequency control device of the intake control valve.

In step 29, the effective fuel injection pulse width Tem for the fuel injection valve 15 is obtained by subtracting the target value PASET for the fuel vapor intake amount converted to an injection pulse width by multiplying by a conversion constant "m", from an effective pulse width Te set for the engine operating conditions (engine rotational speed N, intake flow rate Q, water temperature Tw etc.) for the case when the fuel vapor treatment for the fuel injection valve 15 is not carried out.

In step 30, the correction injection pulse width Ts due to battery voltage correction is added to the effective injection pulse width Tern to give an injection pulse width T1. An injection pulse signal of pulse width T1 is then output to the fuel injection valve 15.

In step 31, it is judged if the engine operating conditions have changed from the engine rotational speed N, and the engine load Tp.

In step 31, if the engine operating conditions have not changed, control returns to step 26, and continues. On the other hand, if the engine operating conditions have changed, then control is terminated.

In this way, with the second embodiment, as with the first embodiment, the overall air-fuel ratio for the engine 11 can be controlled to remain constant. Also, during fuel vapor intake control, by controlling the open and close frequency "f" of the intake control valve 30 to increase or decrease with time TM, differences in air-fuel ratio for each cylinder can be suppressed, so that a desired air-fuel ratio averaged between cylinders can be obtained. Consequently, combustion fluctuations between cylinders can be suppressed, the discharge amount of exhaust pollutants reduced, and deterioration in vehicle driving performance minimized.

With the above embodiments, steps 11 through 14, and steps 21 through 24 constitute the intake amount control device and the intake amount correction device, respectively. However the target value PASET for the intake amount of fuel vapor may be obtained by other methods. Furthermore, without intake amount control, that is without an intake amount control device and intake amount correction device, then after presetting the open valve duty PADUTY, even if only the open and close frequency is controlled according to the above respective embodiments, suppression of the biased intake of fuel vapor to a specific cylinder is still possible according to the present invention. Moreover, with an intake amount control device, but without an intake amount correction device, it is obvious that the suppression of the biased intake of fuel vapor to a specific cylinder is still possible in the same way according to the present invention.

What is claimed is:

1. A method for controlling the treatment of fuel vapor of an internal combustion engine comprising:

temporarily absorbing and storing fuel vapor from a fuel tank in an absorption means;

detecting operating conditions of the engine;

introducing, under predetermined engine operating conditions, a negative intake pressure of the engine to said absorption means through a periodically opened and closed intake control valve disposed between said absorption means and an intake system of the engine, to thereby desorb the absorbed fuel vapor and supply the fuel vapor to the intake system; and variably controlling the open and close frequency of the intake control valve.

2. A method for controlling the treatment of fuel vapor of an internal combustion engine as claimed in claim 1, wherein said variably controlling step includes the step of variably controlling to increase the open and close frequency of said intake control valve with an increase of engine rotational speed.

3. A method for controlling the treatment of fuel vapor of an internal combustion engine as claimed in claim 1, wherein said variably controlling step includes the step of variably controlling to one of increase and decrease the open and close frequency of said intake control valve with an elapsed time.

4. A method for controlling the treatment of fuel vapor of an internal combustion engine comprising:

temporarily absorbing and storing fuel vapor from a fuel tank in an absorption means;

detecting operating conditions of the engine;

introducing, under predetermined engine operating conditions, a negative intake pressure of the engine to said absorption means through a periodically opened and closed intake control valve disposed between said absorption means and an intake system of the engine, to thereby desorb the absorbed fuel vapor and supply the fuel vapor to the intake system;

setting an open and close time proportion of said intake control valve on the basis of the engine operating conditions detected by said operating conditions detection step, to thereby control an intake amount of the fuel vapor; and variably controlling the open and close frequency of the intake control valve.

5. A method for controlling the treatment of fuel vapor of an internal combustion engine as claimed in claim 4, wherein said variably controlling step includes the step of variably controlling to increase the open and close frequency of the intake control valve with an increase of engine rotational speed.

6. A method for controlling the treatment of fuel vapor of an internal combustion engine as claimed in claim 4, wherein said variably controlling step includes the step of variably controlling to one of increase and decrease the open and close frequency of the intake control valve with an elapsed time.

7. A method for controlling the treatment of fuel vapor of an internal combustion engine as claimed in claim 4, wherein said setting step comprises the step of:

estimating an amount of fuel vapor absorbed by said absorption means, and correcting, in accordance with the estimated fuel vapor amount, the open and close time proportion of the intake control valve set on the basis of the engine operating conditions.

8. A method for controlling the treatment of fuel vapor of an internal combustion engine as claimed in claim 7, wherein said estimating step includes estimating an amount of fuel vapor absorbed by said absorption means, on the basis of temperature conditions of said absorption means.

9. A method for controlling the treatment of fuel vapor of an internal combustion engine as claimed in claim 7, wherein said variably controlling step includes variably controlling to increase the open and close frequency of the intake control valve with an increase of engine rotational speed.

10. A method for controlling the treatment of fuel vapor of an internal combustion engine as claimed in claim 7, wherein said variably controlling step includes variably controlling to one of increase and decrease the open and close frequency of the intake control valve with an elapsed time.

11. An apparatus for controlling the treatment of fuel vapor of an internal combustion engine comprising:

means for temporarily absorbing and storing fuel vapor from a fuel tank in an absorption means;

operating conditions detection means for detecting operating conditions of the engine;

an intake control valve disposed between said absorption means and an intake system of the engine, which intake control valve is periodically opened and closed under predetermined engine operating conditions for introducing a negative intake pressure of the engine to said absorption means, to thereby desorb the absorbed fuel vapor and supply the fuel vapor to the intake system; and open and close frequency control means for variable control of the open and close frequency of the intake control valve.

12. An apparatus for controlling the treatment of fuel vapor of an internal combustion engine as claimed in claim 11, wherein said open and close frequency control means includes means for variable control to increase the open and close frequency of said intake control valve with an increase of engine rotational speed.

13. An apparatus for controlling the treatment of fuel vapor of an internal combustion engine as claimed in claim 11, wherein said open and close frequency control means includes means for variable control to one of increase and decrease the open and close frequency of said intake control valve with an elapsed time.

14. An apparatus for controlling the treatment of fuel vapor of an internal combustion engine comprising:

means for temporarily absorbing and storing fuel vapor from a fuel tank in an absorption means;

operating conditions detection means for detecting operating conditions of the engine;

an intake control valve disposed between said absorption means and an intake system of the engine, which intake control valve is periodically opened and closed under predetermined engine operating conditions for introducing a negative intake pressure of the engine to said absorption means, to thereby desorb the absorbed fuel vapor and supply this to the intake system;

intake amount control means for setting an open and close time proportion of said intake control valve on the basis of the engine operating conditions detected by said operating conditions detection means, to thereby control the intake amount of the fuel vapor; and open and close frequency control means for variable control of the open and close frequency of said intake control valve.

15. An apparatus for controlling the treatment of fuel vapor of an internal combustion engine as claimed in claim 14, wherein said intake amount control means comprises;

fuel vapor amount estimation means for estimating an amount of fuel vapor absorbed by said absorption means, and intake amount correction means for correcting in accordance with the estimated fuel vapor amount, the open and close time proportion of said intake control valve set on the basis of the engine operating conditions.

16. An apparatus for controlling the treatment of fuel vapor of an internal combustion engine as claimed in claim 14, wherein said open and close frequency control means includes means for variable control to increase the open and close frequency of said intake control valve with an increase of engine rotational speed.

17. An apparatus for controlling the treatment of fuel vapor of an internal combustion engine as claimed in claim 14, wherein said open and close frequency control means includes means for variable control to one of increase and decrease the open and close frequency of said intake control valve with an elapsed time.

18. An apparatus for controlling the treatment of fuel vapor of an internal combustion engine as claimed in claim 15, wherein said fuel vapor amount estimation means includes means for estimation of an amount of fuel vapor absorbed by said absorption means, on the basis of temperature conditions of said absorption means.

* * * * *